US007138597B2

(12) United States Patent
Shea et al.

(10) Patent No.: US 7,138,597 B2
(45) Date of Patent: Nov. 21, 2006

(54) CIRCUIT BREAKER WITH ARC GAS PROPELLED MOVABLE CONTACT AND OPPOSED ARC CUTOFF SHUTTERS

(75) Inventors: John J. Shea, Pittsburgh, PA (US); Jeffrey A. Miller, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/988,308

(22) Filed: Nov. 12, 2004

(65) Prior Publication Data

US 2006/0102593 A1 May 18, 2006

(51) Int. Cl.
*H01H 33/14* (2006.01)

(52) U.S. Cl. ..... 218/7; 218/14; 218/117

(58) Field of Classification Search ..... 218/1–7, 218/13, 19, 22, 43, 45, 46, 51, 78–81, 85, 218/86, 114–117, 153, 154
See application file for complete search history.

(56) References Cited

U.S. PATENT DOCUMENTS 4,677,266 A * 6/1987 Belbel et al. ..... 218/117
4,700,030 A 10/1987 Belbel et al.
4,801,772 A * 1/1989 Bratkowski et al. ..... 218/117
4,883,931 A * 11/1989 Batteux et al. ..... 218/46
4,943,691 A 7/1990 Mertz et al.
6,373,014 B1 * 4/2002 Mitsuhashi et al. ..... 218/22

* cited by examiner

*Primary Examiner*—Elvin Enad
*Assistant Examiner*—M. Fishman
(74) *Attorney, Agent, or Firm*—Martin J. Moran

(57) ABSTRACT

The support for the moving contact of a circuit breaker has a piston that is driven by arc gases generated by initial separation of the contacts through magnetic repulsion to rapidly open the contacts. A pair of telescoping shield sleeves that have aligned openings through which the moving contact is extended to close with the fixed contact are oppositely driven transversely to piston movement by the arc gases to cut off the arc.

12 Claims, 3 Drawing Sheets

CIRCUIT BREAKER WITH ARC GAS PROPELLED MOVABLE CONTACT AND OPPOSED ARC CUTOFF SHUTTERS

BACKGROUND OF THE INVENTION

1. Field of the Invention

The invention is directed to a circuit breaker in which the arc gases generated during current interruption are used to open the circuit breaker and to propel shutters that cutoff the arc.

2. Background Information

In a common construction of a low voltage air circuit breaker, the movable contact is mounted on a contact arm that is pivoted to open the contacts by a spring powered operating mechanism triggered by a trip unit responsive to an overcurrent condition in the protected circuit. Even though the contacts open, current continues to flow by way of an arc that is struck between the opening contacts. This arc must be extinguished in order to interrupt the current. Typically, the arc is commutated to an arc chute containing a stack of spaced apart electrically conductive plates that break the arc into a series of smaller arcs that raise the arc voltage thereby aiding in termination of the arc. Simultaneously, the arc is cooled by arc gases formed by the vaporization of the contact and surrounding materials and directed to vents in the circuit breaker housing.

One approach to limiting the let through current during interruption has been to speed up the opening of the contacts. This includes forming a reverse current loop in the conductor leading to the fixed contact to generate magnetic repulsion forces that initiate contact arm opening movement before the opening mechanism has time to respond. Supplemental to this, U.S. Pat. No. 6,204,465 suggests providing paddles on the contact arm against which the expanding arc gases act to accelerate contact opening.

Another approach to limiting let through current, and therefore improving the performance of low voltage circuit breakers, has been to physically cut the arc. U.S. Pat. No. 4,801,772 suggests forcing an insulating wedge between the contacts; however, it has proved difficult to completely cutoff the arc and to reset the spring operated mechanism in this arrangement. U.S. Pat. No. 4,700,030 suggests using the arc gases to drive an insulative closed in cylindrical skirt between the contacts to cutoff the arc.

Despite these approaches, there is still room for improvement in the short circuit interruption performance of low voltage air circuit breakers.

SUMMARY OF THE INVENTION

In accordance with aspects of the invention, the current interruption of a low voltage circuit breaker is improved by using the arc gases generated during interruption to propel the moving contact to the open position. The moving contact is mounted on a piston that is driven along a contact chamber within the circuit breaker housing by the expanding arc gases. The arc gases are generated by vaporization of the contacts and surrounding material as the contacts initially separate such as due to the magnetic repulsion produced by an overcurrent condition.

In accordance with other aspects of the invention, the arc is cut off to complete interruption of the current by a pair of overlapping sliding members that are driven by the arc gases in opposite directions between a first position in which first openings in the sliding members are aligned to define a through opening through which the movable contact extends to close on the fixed contact, and a second position in which the through opening is closed after the moving contact begins to separate from the fixed contact. The sliding members can be telescoping sleeves with closed ends that form an expandable volume in which the arc gases expand to drive the sleeves in opposite directions to thereby rapidly cut off the arc. At least one sleeve has a second opening that aligns with a discharge port in the housing to relieve arc gas pressure when the sleeves reach the second or cut-off position. The telescoping sleeves are then automatically returned to the first position for reclosing of the contacts by bias springs.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
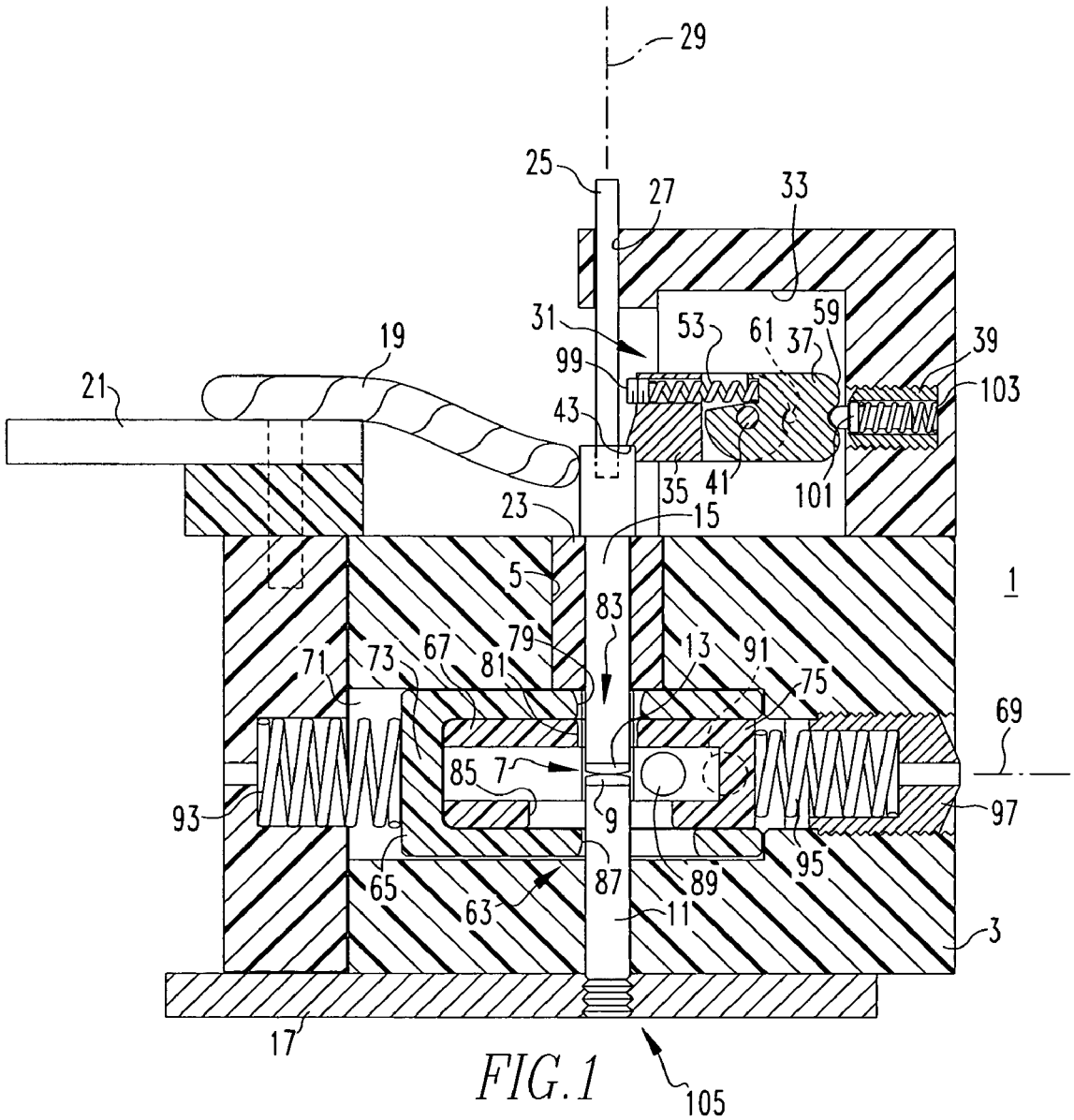
FIG. 1 is a sectional view through a circuit breaker in accordance with the invention shown in the closed position.

Referring to the figures, the circuit breaker 1 has an electrically insulative housing 3 with a vertically extending contact chamber 5. Contained within the chamber 5 are separable contacts 7 including a fixed contact 9 mounted on a fixed support 11 that is electrically conductive and a moving contact 13 mounted on a moving support 15. The fixed support 11 is connected to a line conductor 17 while the moving support that is electrically conductive is connected through a flexible shunt 19 to a load conductor 21. The moving support 15 has a bushing 23 that forms a piston that is slidable in the contact chamber 5 between a closed position shown in FIG. 1 in which the separable contacts 7 are closed, and an open position shown in FIG. 2 in which the separable contacts 7 are open. A guide rod 25 extending from the moving support 15 passes through a bore 27 in the housing 3 to guide the piston 23 and therefore the moving contact 13 along a first axis 29. Alternatively, the guide rod 25 can be fixed to block 3 and pass through a tubular moving support 15. In any event, with the separable contacts 7 closed, current passing through the contacts generates a magnetic repulsion force tending to drive the separable contacts 7 apart.

Figure 3:
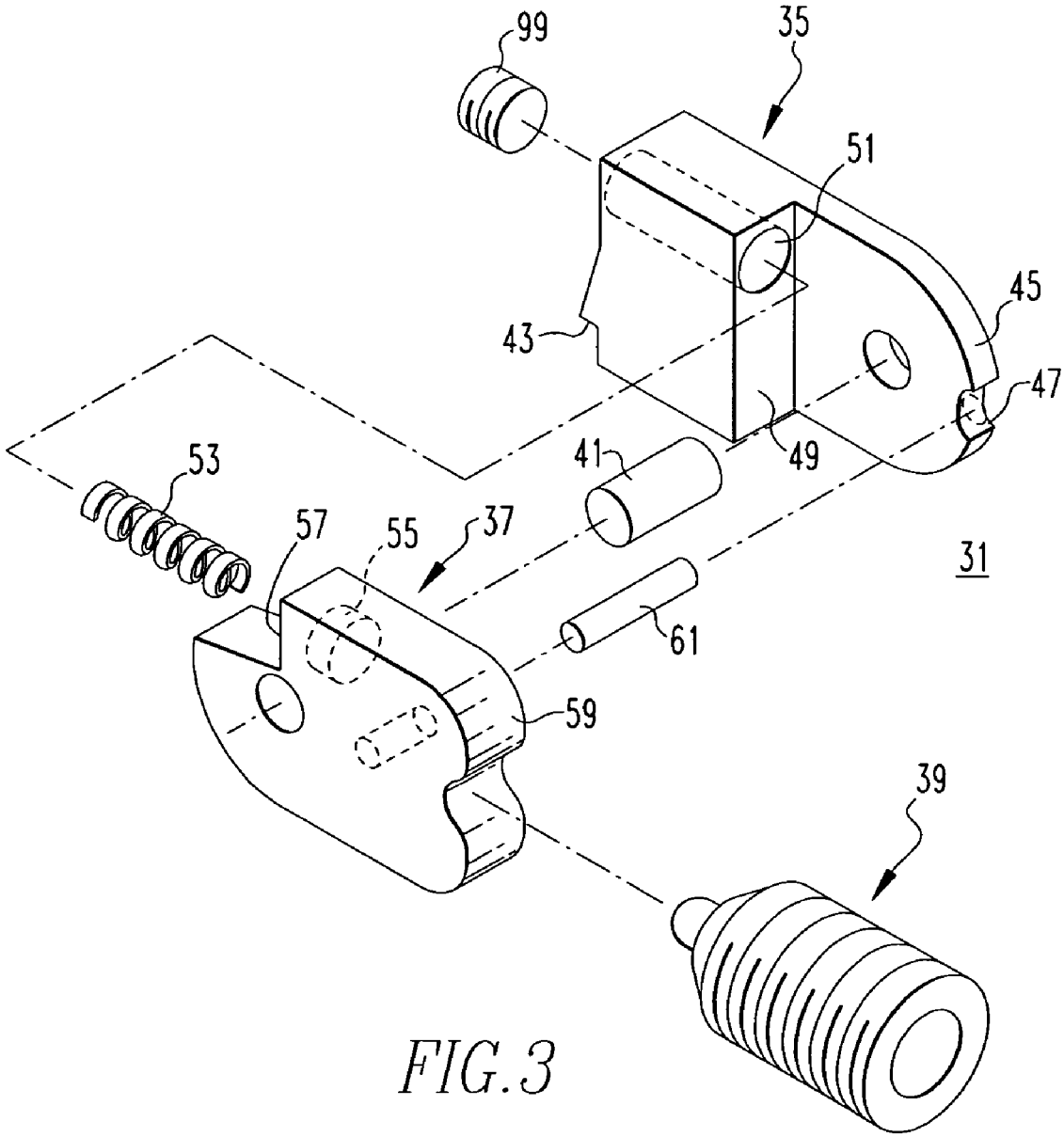
FIG. 3 is an exploded view of a latch assembly that forms part of the circuit breaker of FIGS. 1 and 2.

A latch assembly 31 mounted in a recess 33 in the housing 3 latches the separable contacts 7 in the closed position. As seen more clearly in FIG. 3, the latch assembly 31 includes a moving latch 35, a cam-over latch 37 and a ball spring plunger 39. The moving latch 35 and cam-over latch 37 are mounted on a common pivot pin 41. The moving latch 35 has at one end a latch shoulder 43 that engages the top of the bushing 23 in the closed position of the separable contacts 7. The other end of the moving latch 35 is semi-circular at 45 with a notch 47 at the center. A recess 51 in a shoulder 49 receives one end of a compression type contact force spring 53. The other end of the compression spring 53 seats in a recess 55 in a shoulder 57 on the cam-over latch 37 facing the shoulder 49. This mounts the contact force spring 53 with its line of action offset from the pivot pin 41 thereby tending to rotate the moving latch 35 and cam-over latch 37 in opposite directions about the pivot pin 41. An end of the cam-over latch 37 opposite the recess 55 has a detented cam surface 59 that is engaged by the ball spring plunger 39. A pin 61 on the cam-over latch 37 engages the notch 47 in the rounded end 45 of the moving latch 35.

Figure 2:
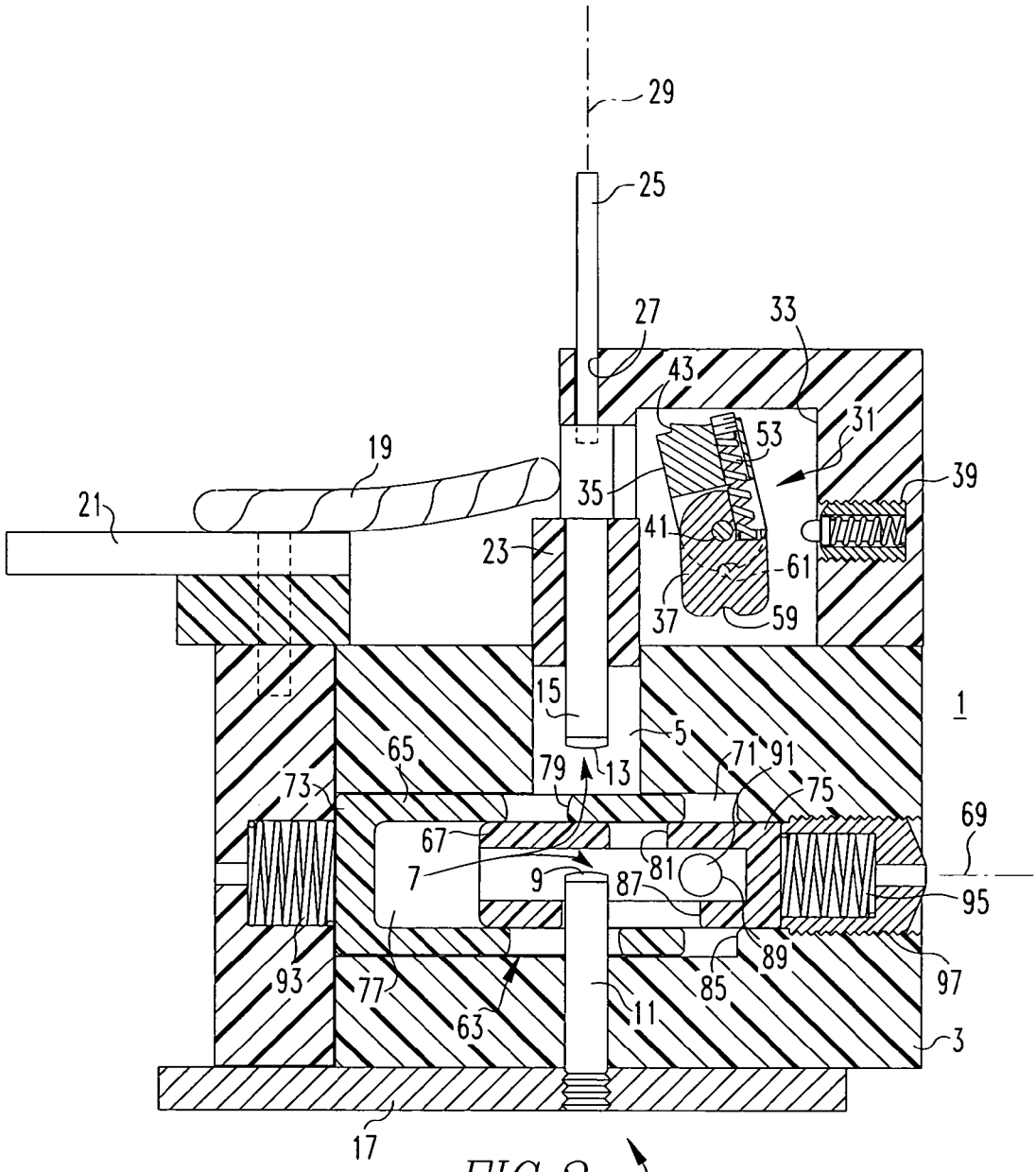
FIG. 2 is a view similar to FIG. 1 but showing the circuit breaker in the open position.

As shown in FIG. 1, with the separable contacts 7 closed, the latch ledge 43 engages the top of the bushing 23. The ball spring plunger 39 engages the detented cam surface 59 with its line of force passing through the pivot pin 41 so that the latch assembly is held in the latched position shown. The compression spring 53 tends to rotate the moving latch 35 counterclockwise as viewed in FIG. 1 so that contact pressure is applied to the separable contacts 7. However, when overcurrent of sufficient magnitude flows through the separable contacts 7, a magnetic repulsion force is generated that applies a clockwise rotation to the latch assembly overcoming the retention force applied by the ball spring plunger 39 so that the latch assembly 31 rotates to the unlatched position shown in FIG. 2. Without the restraint of the latch assembly 31, the moving support 15 moves upward creating an arc as the separable contacts separate. This generates arc gases that expand within the enclosed chamber 5 to rapidly drive the moving support upward to accelerate opening of the contacts 7.

In order to extinguish the arc that extends between the opening contacts 9 and 13, the circuit breaker 1 includes a shield assembly 63. This shield assembly 63 constitutes a pair of overlapping shield members 65 and 67 slidable in opposite directions along a common axis 69 of a cutoff chamber 71 that extends transversely to and intersects the contact chamber 5. In the exemplary embodiment of the invention, the shield members 65 and 67 are telescoping sleeves with the sleeve 67 sliding inside the sleeve 65. The sleeves 65 and 67 are closed at opposite ends 73 and 75, respectively, to form an expandable volume 77. With the two sleeves telescoped inward to a first position shown in FIG. 1, first openings 79 and 81 of the sleeves 65 and 67 aligned to form a through opening 83. In this first position, the moving support 15 can extend through the through opening 83 so that the movable contact 13 can close with the fixed contact 9. The arc gases that are generated with the opening of the separable contacts 7 not only pass through the through opening 83 to drive the bushing 23 upward, but also expand within the expandable volume 77 to drive the sleeves 65 and 67 in opposite directions to a second position shown in FIG. 2. As can be seen from this figure, the first openings 79 and 81 are no longer aligned so that the arc is cut off. Second lateral openings 85 and 87, respectively, permit the sleeves to move to the second position without interference with the fixed support 11. In this second position, a vent hole 89 in the sleeve 67 is aligned with a housing vent 91 so that the exhaust gases are vented from the expandable volume 77. Piston 23 disengages from block 3 to release pressure in chamber 5.

The sleeves 65 and 67 are biased to the first position shown in FIG. 1 by bias springs 93 and 95. The bias on the spring 95 can be adjusted by the threaded plug 97 in which the spring seats. Similarly, the contact force applied by the latch assembly can be adjusted by the set screw 99 that establishes the bias force produced by the compression spring 53, and the latch release point can be adjusted by the adjusting nut 101 that sets the bias of the spring 103 in the ball spring plunger 39. See FIG. 1.

The separable contacts 7 with the moving contact 13 carried by the moving support 15 that includes the piston 23, and the sliding members in the form of the telescoping sleeves 65 and 67 driven by the arc gases to cut off the arc as the contacts separate, form the major components of a current interruption mechanism 105 that is simple yet greatly enhances the current-interruption capability of the breaker 1.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing defining a contact chamber;

a current interruption mechanism comprising:

separable contacts comprising a fixed contact and a moving contact positioned in the contact chamber;

a moving support with a piston by which the moving contact is carried for movement in the contact chamber along a first axis between a closed position in which the separable contacts are closed and an open position in which the separable contacts are open, the piston being driven toward the open position from the closed position by forces comprising: initially a repulsion force generated by an overcurrent through the separable contacts and then also by arc gas produced by an arc generated as the separable contacts separate;

bias means biasing the piston to the closed position; and wherein the current interruption mechanism further comprises at least one shield member slidable across the contact chamber between a first position in which a first opening in the at least one shield member is aligned with the contact chamber to define a through opening through which the moving support extends in the closed position, and a second position in which the first opening does not align with the contact chamber to cut off the arc after the piston has begun movement toward the open position.

2. The circuit breaker of claim 1 wherein the housing further defines a cut off chamber transversely intersecting the contact chamber and at least one shield member is mounted in the cut off chamber and is driven in the cut off chamber from the first position to the second position by the arc gases.

3. The circuit breaker of claim 2 wherein the at least one shield member comprises a pair of overlapping shield members each having a first opening slidably in opposite directions within the cut off chamber across the contact chamber between a first position in which the first openings in the pair of shield members align to define the through opening through which the moving support extends in the closed position and a second position in which the through opening is closed to cutoff the arc after the piston has begun movement to the open position.

4. The circuit breaker of claim 1 wherein the at least one shield member comprises a pair of overlapping shield members each have a first opening and slidable across the contact chamber between the first position in which the first openings in the pair of shield members are aligned with the contact chamber to define the trough opening and a second position in which the first openings do not align with each other to cut off the arc after the piston has begun movement toward the open position.

5. The circuit breaker of claim 4 wherein the current interruption mechanism further includes bias springs biasing the pair of shield members to the first position.

6. A circuit breaker comprising:

a housing defining a cut off chamber;

a shield assembly comprising a pair of overlapping shield members slidable in opposite directions along a common axis within the cut off chamber between a first position in which first openings in the pair of shield members align to define a through opening and a second position in which the through opening is closed;

a fixed support and a moving support;

separable contacts comprising a fixed contact mounted on the fixed support and a moving contact mounted on the moving support which is movable between a closed position in which, with the pair of shield members in the first position, the moving support extends through the through opening to bring the moving contact into contact with the fixed contact and an open position in which moving support is withdrawn from the through opening to open the separable contacts, the shield members being driven in the opposite directions rapidly to the second position by arc gases produced by an arc generated between the fixed contact and the moving contact as to separable contacts open, to cut off and extinguish the arc.

7. The circuit breaker of claim 6 wherein the shield assembly further comprises a pair of return springs biasing the pair of shield members to the first position.

8. The circuit breaker of claim 6 wherein the pair of shield members comprises a pair of telescoping sleeves having oppositely facing closed ends to form an expandable volume in which the arc gases expand to drive the telescoping sleeves to the second position.

9. The circuit breaker of claim 8 wherein the first openings are lateral openings in the telescoping sleeves through which the moving support extends in the closed position, and wherein the telescoping sleeves have second lateral openings of the sleeves through which the fixed support extends, the second lateral openings being elongated to accommodate movement of the pair of telescoping sleeves between the first and second positions.

10. The circuit breaker of claim 9 wherein the housing further defines a contact chamber aligned with the through opening with the telescoping sleeves in the first position, the moving support for the moving contact forming a piston in the contact chamber that is driven from the closed position to the open position initially by a repulsion force generated by an overcurrent through the separable contacts and then by the arc gases.

11. The circuit breaker of claim 10 wherein the shield assembly further comprises a pair of return springs biasing the telescoping sleeves to the first position.

12. The circuit breaker of claim 11 wherein the housing further defines a housing vent positioned to exhaust the arc gas from the expandable volume when the telescoping shield members are in the second position.

* * * * *